US005143264A

United States Patent [19]

MacMillan

[11] Patent Number: 5,143,264

[45] Date of Patent: Sep. 1, 1992

[54] FLAT FINISHING BOX APPARATUS FOR DISPENSING MATERIAL IN A VARIETY OF SWATH WIDTHS

[75] Inventor: Donald M. MacMillan, Chilliwack, Canada

[73] Assignee: Concorde Tool Corp., Surrey, Canada

[21] Appl. No.: 650,005

[22] Filed: Feb. 4, 1991

Related U.S. Application Data

[63] Continuation-in-part of Ser. No. 476,827, Feb. 8, 1990, abandoned.

[51] Int. Cl.[5] ..... E04F 21/06

[52] U.S. Cl. ..... 222/567; 401/5; 401/48; 401/171; 425/87

[58] Field of Search ..... 222/386, 567; 401/5, 401/48, 171, 176, 181, 265, 266, 138, 140, 263; 15/235.3; 425/87; 118/413, 415, 419, 108

[56] References Cited

U.S. PATENT DOCUMENTS

| | | | |
|---|---|---|---|
| 2,889,699 | 6/1959 | Ames | 401/266 |
| 2,984,857 | 5/1961 | Ames | 401/5 |
| 3,451,757 | 6/1969 | Stroud et al. | 401/171 |
| 3,888,611 | 6/1975 | Ames | 401/48 |
| 4,516,868 | 5/1985 | Molnar | 401/171 |
| 4,907,955 | 3/1990 | Snipes | 401/48 |

*Primary Examiner*—Andres Kashnikow
*Assistant Examiner*—Karen B. Merritt
*Attorney, Agent, or Firm*—Robert W. Jenny

[57] ABSTRACT

The flat finishing box has attachable/detachable heads each of which comprises a structural part incorporating a mouth and to which an edge assembly and edge assembly adjustment apparatus are attached. Heads are provided for dispensing mud in each of the three standard swath widths, 7", 10" and 12", so that any swath width can be dispensed from one box by interchanging heads attached to the box. The box cover is one extrusion and the bottom and back are another. The hinged edge of the cover has a cylindrical segment along the edge which fits into a partial cylindrical groove in the back, providing a leak proof hinge. Channels are provided to enhance mud flow from portions of the box beyond the width of the mouth of the head being used to the portion within the mouth width.

2 Claims, 3 Drawing Sheets

FLAT FINISHING BOX APPARATUS FOR DISPENSING MATERIAL IN A VARIETY OF SWATH WIDTHS

This application is a Continuation-In-Part application based on application Ser. No. 476,827, filed Feb. 8, 1990, now abandoned.

BACKGROUND OF THE INVENTION

1. Field

The subject apparatus is in the field of hand tools, specifically tools used on the end of a handle. More specifically it is in the field of such tools used in drywall construction for finishing the joints between panels of plasterboard. Still more specifically it is in the field of flat finishing boxes used to dispense a compound, termed mud in the trade, onto the joints and provide a smooth, specifically contoured surface.

2. Prior Art

There is prior art in this field known to the subject inventor and relating to flat finishing boxes as such.

U.S. Pat. No. 2,889,699, issued to Ames, shows a flat finishing box (mastic applicator having interchangeable heads); however, the interchangeable heads comprise one for applying mastic (known as mud in the trade) in corners and the other for use on flat joints between plasterboard panels. There are no provisions for applying the mud in any of three swath widths from a single box. As is well known in the art, commercially available finishing boxes are made in three widths. The narrowest boxes dispense mud in a swath 7 inches wide; the medium width boxes dispense in a swath width of 10 inches and the widest boxes provide a swath 12 inches wide. A box is filled with mud and used until refilling is required. In use a box is attached to the end of a special handle by which it is held against and moved along a joint. It is common procedure to first cover a joint with a 7 inch swath, a 10" swath and finally a 12" swath, although the 10" or 12" swaths may be omitted under certain circumstances. Each swath requires a volume of mud per foot of joint or swath length. Because the 7" swath is applied first, the volume per foot for the 7" width is greater than for the 10" and 12" widths. This fact, coupled with the fact that the box for the 7" width has the least mud capacity of the three boxes, makes it necessary to refill the 7" box most frequently. In order to apply swaths in sequence as described it is necessary to have boxes of the various widths and handles for each or, if not, change handles from box to box. In any case, it is well known that at any given time on a job, approximately two out of three boxes are partially filled with mud and idle and time is used changing handles from box to box.

In view of the above the objectives of the subject invention are to reduce the frequency of refilling boxes providing 7" wide swaths, reduce the number of idle, partially filled boxes, reduce the number of boxes needed to provide a given work capacity, and either reduce the frequency of the need to change handles from box to box or the number of handles required for given work capacity. In other words, the prime objective is to provide a flat finishing box from which mud can be dispensed in any of plurality of swath widths depending on the head attached to the box.

SUMMARY OF THE INVENTION

Description of the subject invention requires description of a conventional flat finishing box. Such a box has two sides, a front, a back, a bottom, termed a working surface for purposes of this disclosure, and a top, termed a cover for purposes of this disclosure. The dimension of the box from front to back is less than the dimension from side to side, the dimension from side to side being the width of the box. The back is narrow compared to the front, giving the box a wedge shaped crossection perpendicular to the width. The working surface is provided with a slot, termed a mouth, at the juncture between it and the front of the box and, in use, the mud is dispensed through the mouth. The cover is hinged at the back (or removable) so that it may be opened to permit clearing out the box and so that when it is forced toward the bottom (working surface), the volume of the space enclosed is decreased, forcing the mud through the mouth. The front is arced so that the cover stays in close proximity to it as it moves and seals are provided between the cover and the front and sides to prevent mud leaks at the junctures of the cover and front and sides. Apparatus termed an edge assembly is attached to the box and includes an edge extending across the front nearest the mouth. Parts called shoes are attached to the working face, at the ends of the edge and mouth and aligned perpendicularly to the long dimension of the edge. Adjoining the shoes are guards, extending from the shoes toward the back edge of the working surface. The exposed surfaces of the guards, shoes and edge lie in a plane except that the edge can be bent, i.e. arced, out of the plane away from the working surface. A handle is attached to the cover. In use the box, filled with mud, is first held against the plasterboard astride a joint, with the tips of the shoes nearest the edge assembly and the ends of the edge in contact with the plasterboard and the center of the edge arced away from the plasterboard. The handle is then manipulated so that the box is moved along the joint and as it moves the cover is closed to force mud out of the mouth to be spread by the edge into a swath having an arced crossectional shape. Apparatus is provided to mechanically adjust the radius of the arc of the edge. In conventional apparatus the mouth and edge extend essentially across the full width of the box.

In the subject apparatus the shoes, edge and edge adjustment apparatus are assembled to structure incorporating the mouth and the assembly is termed the head and the heads are interchangeable on the boxes. The width of the box accommodates a head for making a 12" wide swath of mud, the edge and mouth in this head extending essentially from side to side of the box. In alternate heads, the mouth and edge are centered lengthwise in the head and sized to provide either a 7" wide swath or a 10" wide swath. The width of the swath being produced is adjusted by interchanging heads on a box rather than boxes on a handle. Guards are provided for all mouth widths. The width of the mouth on each head is commensurate with the width of the swath delivered. Provisions are made to allow for flow of the mud in the portions of the box beyond the ends of the mouths of the 7 inch and 10 inch swath width heads when either of those heads in use. Without such provisions the mud in those portions, in effect, has no place to go and tends to restrict the normal function of the box, particularly the movement of the pressure plate (or cover) necessary to expel the mud through the mouth.

It is considered to be understandable from this summary that the invention meets its objectives. No box need ever be idle and partly filled until the last use of the work period. The seven inch width swath requiring the highest volume of mud per foot of joint length is provided from a 12 inch wide box instead of a 7 inch wide box, thus increasing the time between refills by 70%. The number of boxes needed for given work capacity is reduced to ⅓ with corresponding reduction of the number of handles required.

The invention is described in more detail below with reference to the accompanying drawings.

DETAILED DESCRIPTION OF THE INVENTION

Figure 1:
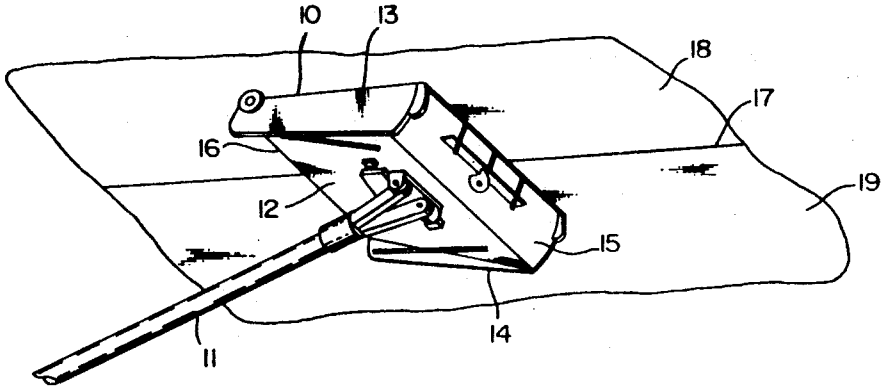
FIG. 1 PRIOR ART
FIG. 1 is a perspective view of a prior art flat finishing box with a handle attached and ready for use on a joint between plasterboard panels.

The subject invention is flat finishing apparatus comprising a box assembly which can be fitted with any of a plurality of heads. There are preferably 3 heads, each configured to provide one of the three standard width swaths of the plastering compound termed mud in the trade, the standard widths being 7", 10" and 12". FIG. 1 illustrates a prior art box 10 being supported and operated by handle 11 attached to the cover 12 of the box. The box has two sides 13 and 14, a front 15, a back 16 and a bottom termed, for purposes of this disclosure, the working surface held in this view astride joint 17 between plasterboard panels 18 and 19 and ready to dispense mud to fill in and smooth over the joint. Prior art boxes each provide one of the three standard swath widths of dispensed mud, a different box being required for each swath width applied to each joint finished.

Figure 2:
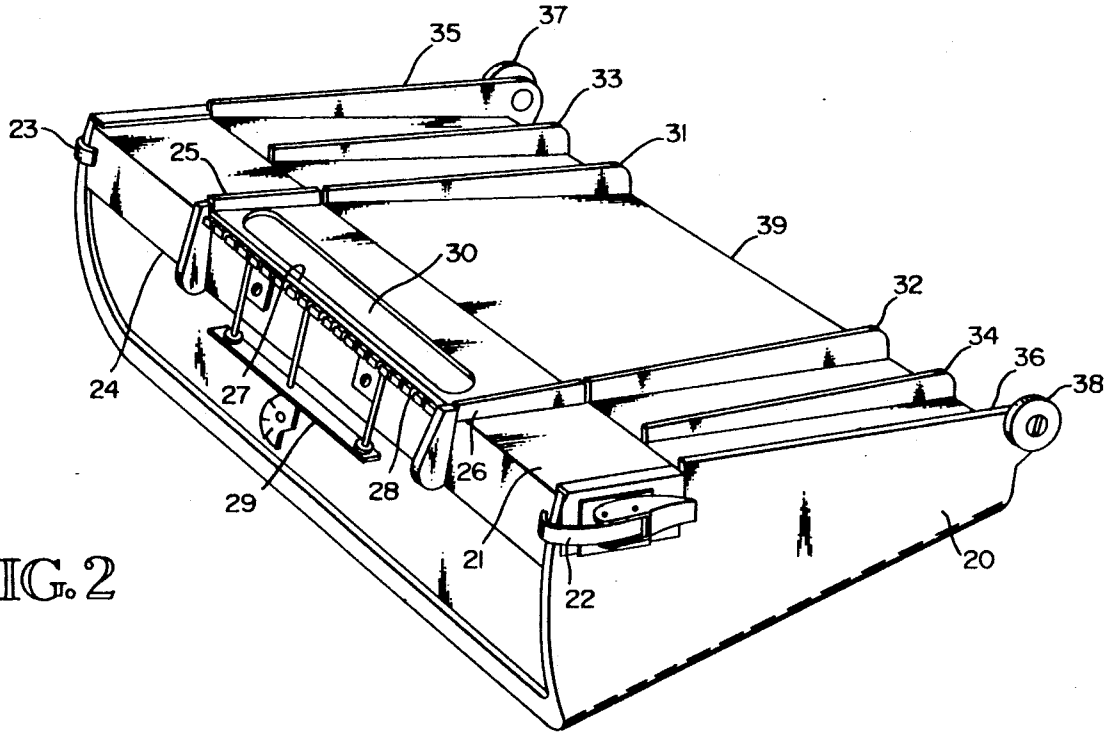
FIG. 2 is a perspective view of the subject invention showing the front, side, working face and the head for producing a 7" wide swath.

With the subject invention, shown in FIG. 2, one box can be used to dispense mud in all three swath widths by using three different heads on the box assembly. In FIG. 2 box 20 is fitted with head 21 held in place by clips 22 and 23. Head 21 is configured to dispense a 7" swath width. The head is an assembly of parts and comprises a base 24, shoes 25 and 26, edge 27 in edge assembly 28 and the edge support and adjustment mechanism 29. The edge and its support and adjustment mechanism are commercially available apparatus attached to the base. The length of the edge assembly is termed its width for purposes of this disclosure. Opening 30 in the base is the mouth, through which the box is filled with mud and through which the mud is dispensed to be shaped and smoothed by the edge. The long dimension of the mouth is termed its width for purposes of this disclosure. The shoes and guards 31, 32, 33 and 34 are positioned at the ends of the mouth and keep the dispensed mud within the swath width produced by a particular head, guards 31 and 32 being for a 7 inch head. To change swath widths one head is removed by releasing clips 22 and 23 and another head installed and clipped into place. The shoes of a head for a 10" swath width will align with guards 33 and 34. In the head for a 12" swath width the edge assembly and mouth extend from side to side of the box and sides 35 and 36 serve as the guards. In all cases contact between the box and the plasterboard is confined to the ends of the shoes in contact with the edge assembly and rollers 37 and 38, attached to the sides near the back 39 of the box. There is enough clearance between the guards and the plasterboard to prevent marking of a wider swath by the guards for a narrower swath.

Figure 3:
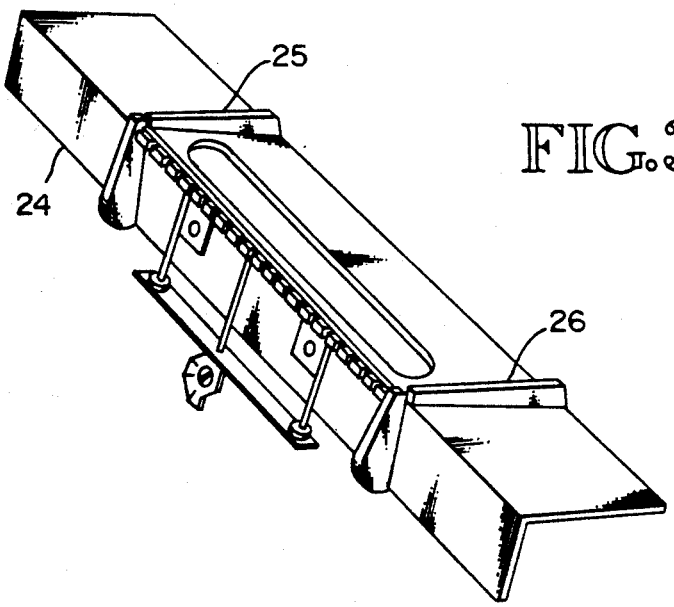
FIG. 3 is a perspective view of a head.
Figure 4:
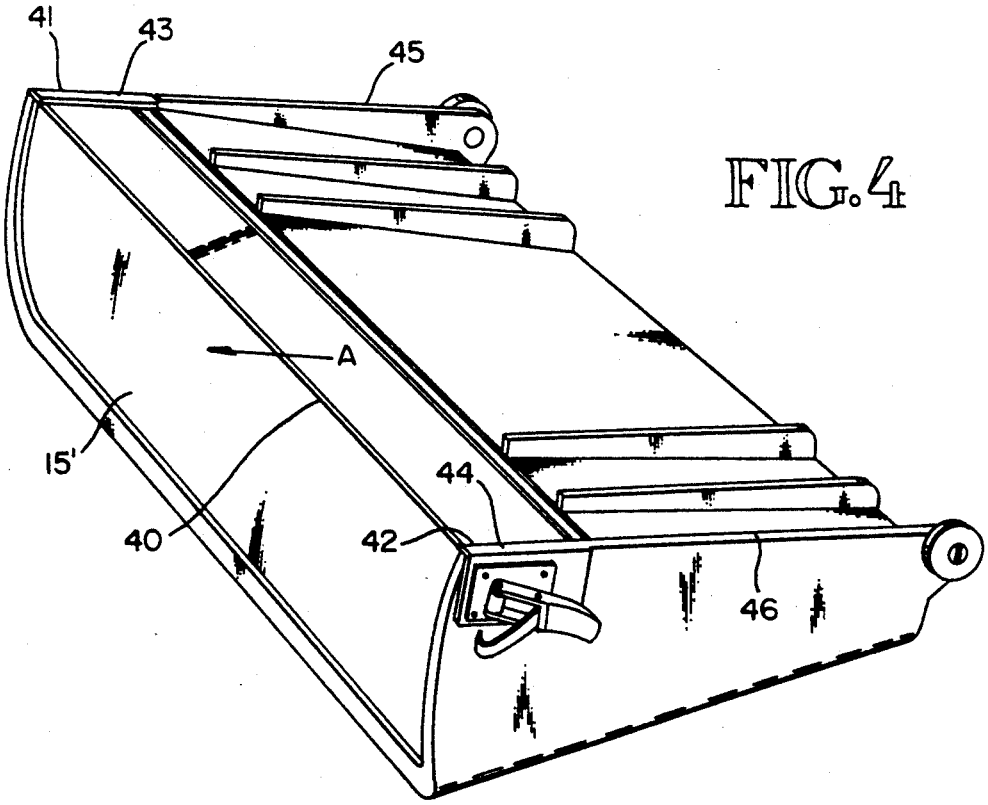
FIG. 4 is a perspective view of the box with no head in place.

FIG. 3 illustrates a head removed from the box and a box assembly with the head removed is shown in FIG. 4. Front 15 of the box assembly is bowed slightly at its edge 40 in the direction of arrow A. This assures a tighter fit between edge 40 and the base 21 of the head to prevent leakage of the mud. Angle plates 41 and 42 are held in place by the fasteners which attach clips 22 and 23 and the ends of the base of the head are held between lips 43 and 44 of the angle plates and the sides of the box assembly. The sides are notched so that the lips are flush with edges 45 and 46 of the sides.

Figure 5:
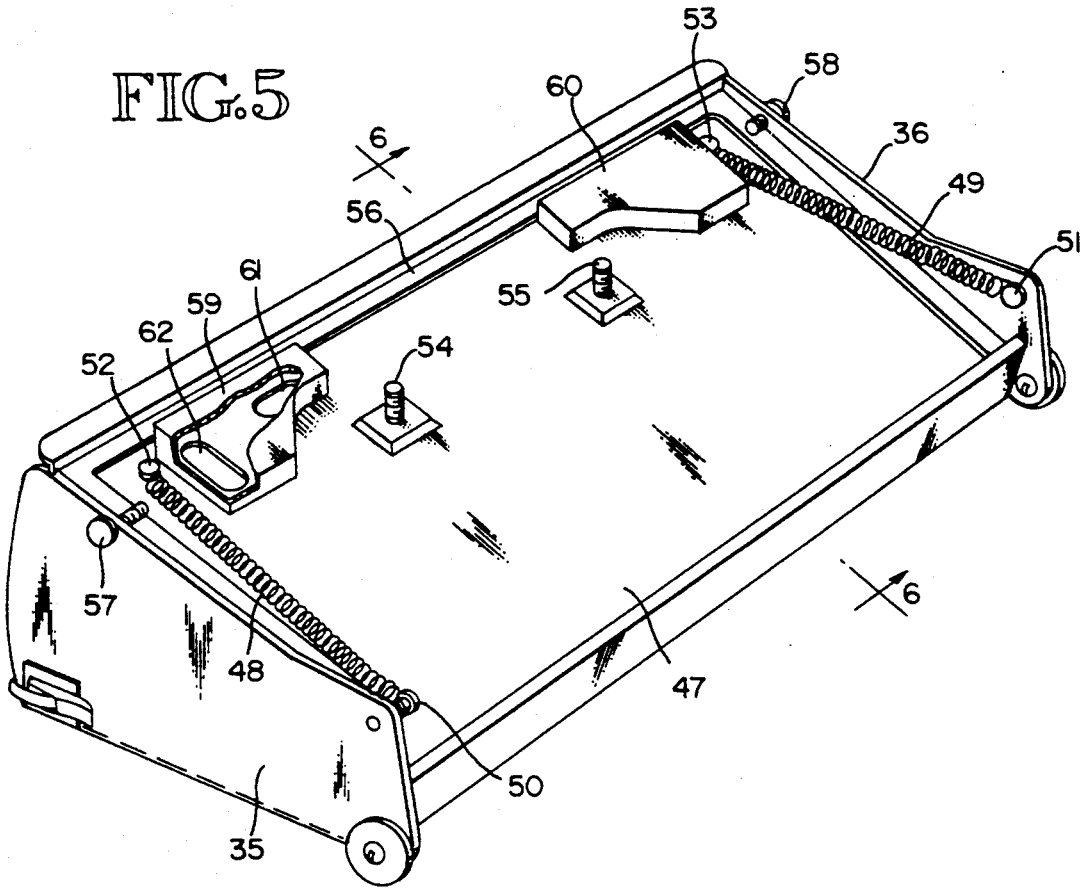
FIG. 5 is a perspective view of the box from the cover side.

FIG. 5 illustrates the box from the cover side, showing cover 47 and cover return springs 48 and 49, connected as fasteners 50 and 51 on the sides 35 and 36 and at pins 52 and 53 on the cover. Threaded studs 54 and 55 are for the attachment of the handle. Seal 56 extends around the front and sides of the cover. Thumbscrews 57 and 58 limit the travel of the cover which can be opened when the thumbscrews are backed out clear of the seal. Opening the cover expedites cleaning the box.

Channel boxes 59 and 60 are attached to cover 47 to provide channels for mud in the box to flow from ports in portions of the box near the extremities of its width in the center portion of the box through ports in the cover provided for the purpose, ports 61 and 62 being typical and visible through the cutaway portion of box 59. The ports and channel boxes comprise channels so that when the 7 inch wide and 10 inch wide heads are used, mud which tends to be trapped in the portions of the box beyond the 7 inch wide and 10 inch wide mouths can flow from these portions to the center portion nearer the mouth of the head being used.

Figure 6:
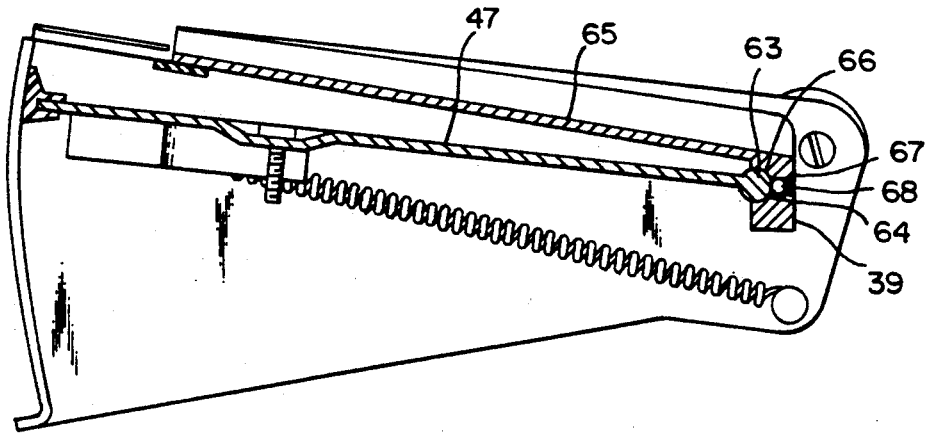
FIG. 6 is a sectional view taken at 4—4 in FIG. 2 illustrating the cover hinge configuration.

The cover is hinged to the back 39 of the box assembly as shown in FIG. 6, a section taken at 6—6 in FIG. 5. The cover 47 is an extrusion with a partial cylindrical segment 63 at its back edge 64. The back 39 and working surface 65 are segments of an extrusion and the back has a partial cylindrical groove 66 into which segment 63 of the cover is fitted. A seal groove 67, holding cylindrical elastomeric gasket 68 extends the full length of groove 66 and is located as shown, essentially opposite the open portion of the partial cylindrical groove. This hinging technique prevents leakage through or around the connection of the cover to the back.

It is considered understandable from this description that the invention meets its objectives. The frequency of refilling boxes providing a seven inch swath width is reduced because a box 12 inches wide instead of seven inches wide is used. Also, since one box can be used to provide all swath widths, each box can be used until it is empty, reducing the number of boxes needed for given work capacity and the number of boxes left partially filled and reducing also either the number of handles needed or the frequency of the need to change handles from box to box, relative to work capacity.

It is considered that it will also be understood that while one embodiment of the invention is described, other embodiments and modifications of the one described are possible within the scope of the invention which is limited only by the attached claims.

I claim:

1. A flat finishing apparatus comprising, in combination, a box assembly and a plurality of attachable/-detachable heads, each of said plurality of heads comprising a base, an edge assembly and an edge assembly adjustment apparatus, said base incorporating a mouth having a first width, said edge assembly having a second width corresponding to said first width, said edge assembly and edge assembly adjustment apparatus being attached to said base, said first and second widths being different in each of said plurality of heads, whereby said apparatus is adapted to dispense material in a variety of swath widths from said box assembly.

said box assembly further having a third width, first and second extremities of said third width, a center portion, a first portion near said first extremity of said third width, a second portion near said second extremity of said third width and a first channel interconnecting said first portion to said center portion and a second channel interconnecting said second portion to said center portion.

2. The flat finishing apparatus of claim 1 whereby said apparatus is used to dispense mud and each of said plurality of heads is configured to produce a specific swath width of mud dispensed by said apparatus and said mouth has a first end and a second end and said apparatus further comprises shoes and guards permanently positioned on said heads and said base at said first and second mouth ends whereby said dispensed mud is kept within said swath width.

* * * * *